US010504459B2

(12) United States Patent
Chen

(10) Patent No.: US 10,504,459 B2
(45) Date of Patent: Dec. 10, 2019

(54) OVER-DRIVING APPARATUS, STORAGE METHOD THEREOF, AND DISPLAY DEVICE USING THE SAME

(71) Applicants: HKC Corporation Limited, Shenzhen, Guangdong (CN); Chongqing HKC Optoelectronics Technology Co., Ltd., Chongqing (CN)

(72) Inventor: Yu-Jen Chen, Chongqing (CN)

(73) Assignees: HKC CORPORATION LIMITED, Shenzhen, Guangdong (CN); CHONGQING HKC OPTOELECTRONICS TECHNOLOGY CO., LTD., Chongqing (CN)

( * ) Notice: Subject to any disclaimer, the term of this patent is extended or adjusted under 35 U.S.C. 154(b) by 7 days.

(21) Appl. No.: 15/546,137

(22) PCT Filed: May 31, 2017

(86) PCT No.: PCT/CN2017/086648
§ 371 (c)(1),
(2) Date: Jul. 25, 2017

(87) PCT Pub. No.: WO2018/205323
PCT Pub. Date: Nov. 15, 2018

(65) Prior Publication Data

US 2018/0336852 A1 Nov. 22, 2018

(30) Foreign Application Priority Data

May 12, 2017 (CN) ..... 2017 1 0335004

(51) Int. Cl.
*G09G 3/36* (2006.01)

(52) U.S. Cl.
CPC ..... *G09G 3/3607* (2013.01); *G09G 3/3677* (2013.01); *G09G 3/3688* (2013.01);
(Continued)

(58) Field of Classification Search
CPC ..... G09G 2320/0252; G09G 2340/16; G09G 3/3607; G09G 3/36; G09G 2320/0285;
(Continued)

(56) References Cited

U.S. PATENT DOCUMENTS

2010/0020054 A1* 1/2010 Jepsen ..... G09G 3/3685 345/208
2013/0307886 A1* 11/2013 Lee ..... G09G 3/3406 345/691

FOREIGN PATENT DOCUMENTS

CN 101202020 A 6/2008
CN 101364386 A * 2/2009 ..... G09G 3/20
(Continued)

OTHER PUBLICATIONS

International Search Report of PCT/CN2017/086648, dated Feb. 12, 2018.

*Primary Examiner* — Duc Q Dinh
(74) *Attorney, Agent, or Firm* — Locke Lord LLP; Tim Tingkang Xia, Esq.

(57) ABSTRACT

This application provides an over-driving apparatus, a storage method thereof, and a display device using same. The over-driving apparatus, applied to a liquid crystal display (LCD) panel, is configured to receive multiple pixel grayscale values corresponding to one pixel in multiple images and output multiple over-driving grayscale values correspondingly, wherein the over-driving apparatus includes: a pixel information processing unit, configured to receive a color information of the pixel; a first storage unit, configured to store the pixel grayscale values; a second storage unit, configured to store a difference value of the pixel grayscale
(Continued)

values stored in the first storage unit; and an over-driving correspondence selection unit, separately electrically coupled to the pixel information processing unit, the first storage unit, and the second storage unit, and configured to select, according to the color information, received by the pixel information processing unit, of the pixel, whether the pixel grayscale values of the pixel need to correspond to the first storage unit or the second storage unit.

6 Claims, 7 Drawing Sheets

(52) U.S. Cl.
CPC ..... *G09G 2310/08* (2013.01); *G09G 2360/12* (2013.01); *G09G 2360/16* (2013.01)

(58) Field of Classification Search
CPC ..... G09G 2330/021; G09G 2320/0242; G09G 3/2022; G09G 3/3685; G09G 2320/0666; G09G 2320/0271; G09G 2300/0443; G09G 2310/0275; G09G 3/3266; G09G 3/3233; G09G 2320/043; G09G 2320/0276; G09G 2310/0251; G09G 2320/0257; G09G 2310/0289; G09G 2320/068; G09G 2320/103; G09G 2320/0247
USPC ..... 345/98–102
See application file for complete search history.

(56) References Cited

FOREIGN PATENT DOCUMENTS

| | | | |
|---|---|---|---|
| CN | 101364386 | A | 2/2009 |
| CN | 102855857 | A | 1/2013 |
| JP | 2008089943 | A | 4/2008 |
| JP | 2009031384 | A | 2/2009 |

* cited by examiner

| | | | |
|---|---|---|---|
| a1 | a2 | a3 | a4 |
| a5 | a6 | a7 | a8 |
| a9 | a10 | a11 | a12 |
| a13 | a14 | a15 | a16 |

FIG. 4a

| | | | |
|---|---|---|---|
| b1 | - | - | b4 |
| - | - | b7 | - |
| - | - | - | - |
| - | - | b15 | - |

FIG. 4b

OVER-DRIVING APPARATUS, STORAGE METHOD THEREOF, AND DISPLAY DEVICE USING THE SAME

BACKGROUND

Technical Field

This application relates to a storage method, and in particular, to an over-driving apparatus, a storage method thereof, and a display device using the same.

Related Art

Liquid crystal displays (LCDs) have been widely applied in recent years. As the drive technology is improved, the LCDs have advantages such as low electric power consumption, a thin and light design, and low-voltage driving. Currently, the LCDs have been widely applied to camcorders, notebook computers, desktop displays, and various projection devices.

In addition, most of the existing LCDs use an over driving (OD) technology, to increase the reaction speed of liquid crystal molecules. The OD technology is that over-driving processing is performed according to a previous image and a current image, to obtain a corresponding over-driving voltage to drive liquid crystal molecules. Therefore, data of the previous picture needs to be temporarily stored in a memory when the OD technology is used.

Moreover, to improve response time of liquid crystal panels, the OD technology is widely applied. The principle of the OD technology is that grayscale change values of each pixel of images of two successive frames are compared, and grayscale values needing over-driving are obtained by means of table lookup. In addition, because adjustments need to be made for different colors during actual adjustment, two or more OD tables storing OD data are needed. Therefore, to reduce the foregoing storage space storing the OD data, a storage method with low manufacturing costs is provided.

SUMMARY

To resolve the foregoing technical problem, an objective of this application is to provide an over-driving apparatus, a storage method thereof, and a display device using same, so as to reduce storage costs by reducing space needed by over-driving storage, thereby improving the quality of products.

The objective of this application is achieved and the technical problem thereof is resolved by using the following technical solutions. An over-driving apparatus provided according to this application, applied to an LCD panel, is configured to receive a plurality of pixel grayscale values corresponding to one pixel in a plurality of images and output a plurality of over-driving grayscale values correspondingly, wherein the over-driving apparatus comprises: a pixel information processing unit, configured to recognize a color information of the pixel; a first storage unit, configured to store the pixel grayscale values; a second storage unit, configured to store a difference value of the pixel grayscale values stored in the first storage unit; and an over-driving correspondence selection unit, separately electrically coupled to the pixel information processing unit, the first storage unit, and the second storage unit, and configured to select, according to the color information, recognized by the pixel information processing unit, of the pixel, whether the pixel grayscale values of the pixel need to correspond to the first storage unit or the second storage unit.

Another objective of this application is a storage method of an over-driving apparatus, comprising: receiving, by a pixel information processing unit, a pixel generated by an LCD panel; recognizing, by the pixel information processing unit, the pixel, to obtain pixel grayscale values; selecting, by an over-driving correspondence selection unit, a corresponding result of the pixel grayscale values; and determining, according to the corresponding result of the pixel grayscale values, whether the pixel is stored in a first storage unit or a second storage unit, where the over-driving apparatus comprises a plurality of data driving chips, a plurality of gate driving chips, and a power control chip.

This application may further resolve the technical problem thereof by using the following technical measures.

In an embodiment of this application, the over-driving correspondence selection unit further comprises: a querying and comparing unit, configured to determine, through query and comparison, whether the pixel should obtain data from the first storage unit to perform over-driving or obtain data from the second storage unit to perform over-driving.

In an embodiment of this application, the pixel grayscale values stored in the first storage unit are fixed values.

In an embodiment of this application, the difference value stored in the second storage unit and of the pixel grayscale values stored in the first storage unit is a variable value.

In an embodiment of this application, the over-driving apparatus further comprises a plurality of data driving chips, a plurality of gate driving chips, and a power control chip.

In an embodiment of this application, the over-driving apparatus further comprises a timing controller, separately electrically connected to the data driving chips, the gate driving chips, and the power control chip.

In an embodiment of this application, in the storage method, the step of determining, according to the corresponding result of the pixel grayscale values, whether the pixel is stored in a first storage unit or a second storage unit comprises: determining, by a querying and comparing unit, the corresponding result of the pixel grayscale values, where the querying and comparing unit is configured to query and compare where the pixel should obtain data from the first storage unit to perform over-driving or obtain data from the second storage unit to perform over-driving.

In an embodiment of this application, the storage method further comprises a timing controller, separately electrically connected to the data driving chips, the gate driving chips, and the power control chip.

Still another objective of this application is a display device, comprising: a first substrate; a second substrate, disposed opposite to the first substrate; a first polarizer, disposed on an external surface of the first substrate; and a second polarizer, disposed on an external surface of the second substrate, where a polarization direction of the first polarizer is parallel to a polarization direction of the second polarizer; and the display device further comprises an over-driving apparatus, disposed on the first substrate or on the second substrate.

This application reduces storage costs by reducing space needed by over-driving storage, so as to improve the quality of products.

BRIEF DESCRIPTION OF THE DRAWINGS

FIG. 4*a* is an OD table storing a second-color pixel and a third-color pixel according to an embodiment of this application;

FIG. 4*b* is an OD table storing a first-color pixel according to an embodiment of this application;

DETAILED DESCRIPTION

Figure 1:
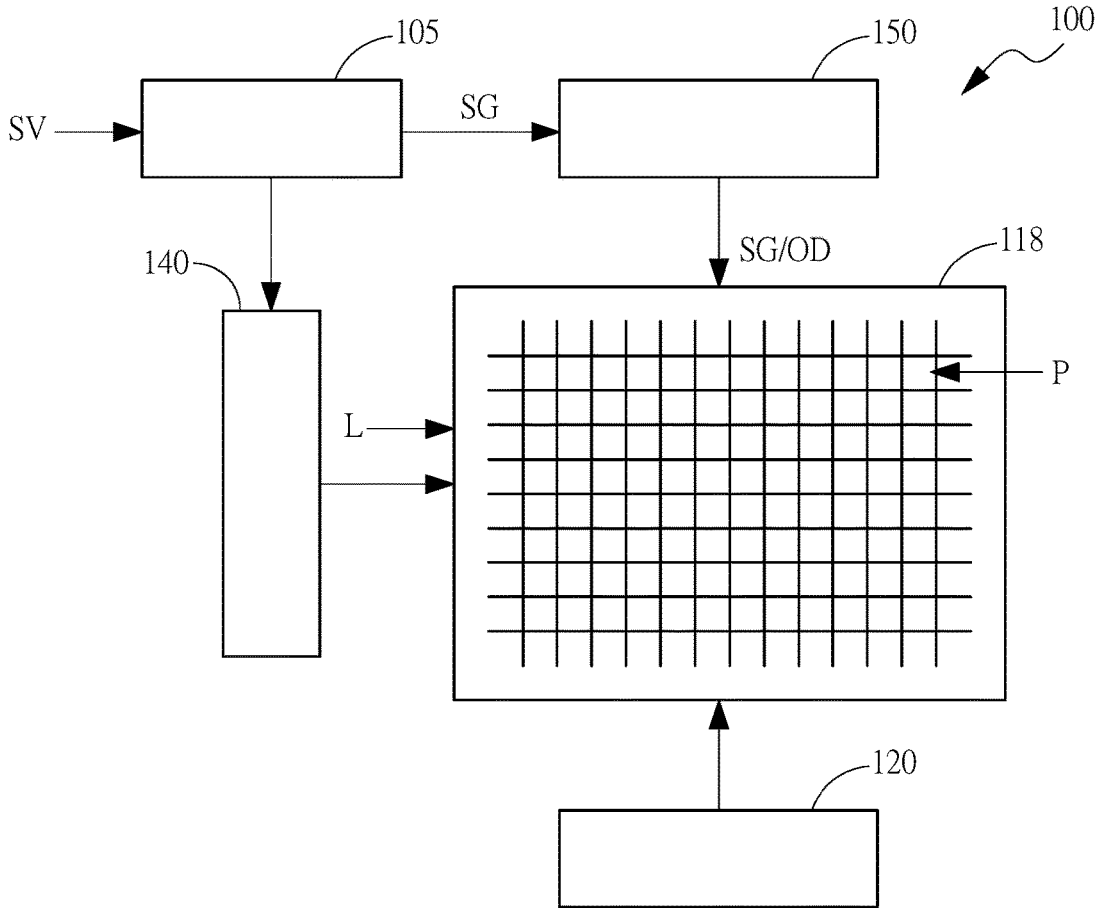
FIG. 1 is a systematic block diagram of an exemplary LCD device.

The following embodiments are described with reference to the accompanying drawings, which are used to exemplify specific embodiments for implementation of this application. Terms about directions mentioned in this application, such as "on", "below", "front", "back", "left", "right", "in", "out", and "side surface" merely refer to directions of the accompanying drawings. Therefore, the used terms about directions are used to describe and understand this application, and are not intended to limit this application.

In the embodiments of this application, to assist explaining a storage method of this application, it is assumed that an over-driving apparatus is used to implement the storage method of this application. However, it should be understood that, the apparatus and/or the method may change, and the apparatus and the method do not need to work in association with each other completely according to what described below. The changes fall within a scope of current embodiments. It may be understood that, in some embodiments, the storage method of this application may be implemented by using an over-driving apparatus. For example, the method is implemented by operating a driving chip. It should be emphasized that, unless otherwise specified, the storage method of this application does not need to be implemented according to an exact sequence shown in a figure. In addition, multiple similar blocks may be implemented in parallel rather than in sequence. Therefore, elements of the storage method of this application are referred to as "blocks" rather than "steps". It should also be understood that, the storage method may also be implemented by using a transformation of the over-driving apparatus. It may be further understood that, the storage method of this application can be implemented in a storage system. However, the method may also be implemented in a similar system having components similar to components of the storage system but disposed in a different configuration.

The accompanying drawings and the description are considered to be essentially exemplary, rather than limitative. In figures, units with similar structures are represented by using the same reference number. In addition, for understanding and ease of description, the size and the thickness of each component shown in the accompanying drawings are arbitrarily shown, but this application is not limited thereto.

In the accompanying drawings, for clarity, thicknesses of a layer, a film, a panel, an area, and the like are enlarged. In the accompanying drawings, for understanding and ease of description, thicknesses of some layers and areas are enlarged. It should be understood that when a component such as a layer, a film, an area, or a base is described to be "on" "another component", the component may be directly on the another component, or there may be an intermediate component.

In addition, in this specification, unless otherwise explicitly described to have an opposite meaning, the word "include" is understood as including the component, but not excluding any other component. In addition, in this specification, "on" means that a component is located on or below a target component, but does not mean that the component needs to be located on top of the gravity direction.

To further describe the technical means adopted in this application to achieve the intended inventive objective and effects thereof, specific implementations, structures, features, and effects of an over-driving apparatus, a storage method thereof, and a display device using same provided according to this application are described below in detail with reference to the drawings and preferred embodiments.

A liquid crystal panel of this application may include a thin film transistor (TFT) substrate, a color filter (CF) substrate, and a liquid crystal layer formed between the two substrates.

In an embodiment, a liquid crystal panel of this application may be a curved-surface display panel.

In an embodiment, a TFT and a CF of this application may be formed on a same substrate.

FIG. 1 is a systematic block diagram of an exemplary LCD device. Referring to FIG. 1, a liquid crystal display device 100 includes an LCD panel 118, a light emitting diode (LED) backlight module 120, a timing controller (T-con) 105, a gate driver 140, and a source driver 150. The timing controller 105 receives a video signal SV to control the gate driver 140 and the source driver 150 according to image data transmitted by the video signal SV, and the timing controller 105 outputs a current grayscale value SG to the source driver 150. The gate driver 140 is controlled by the timing controller 105, to enable each column of pixels (for example, a pixel column L) in the LCD panel 118 one by one. The source driver 150 is also controlled by the timing controller 105 to provide a corresponding target over-driving value OD according to the current grayscale value SG or provide the current grayscale value SG to the columns of pixels enabled by the gate driver 140, in the LCD panel 118. The target over-driving value OD is used to accelerate rotation of liquid crystals in the LCD panel 118. The LED backlight module 120 provides a surface light source needed by the LCD panel 118. After the source driver 150 provides the corresponding grayscale value SG to the last column of pixels in the LCD panel 118, the LCD panel 118 can display a complete image to a user.

Figure 2:
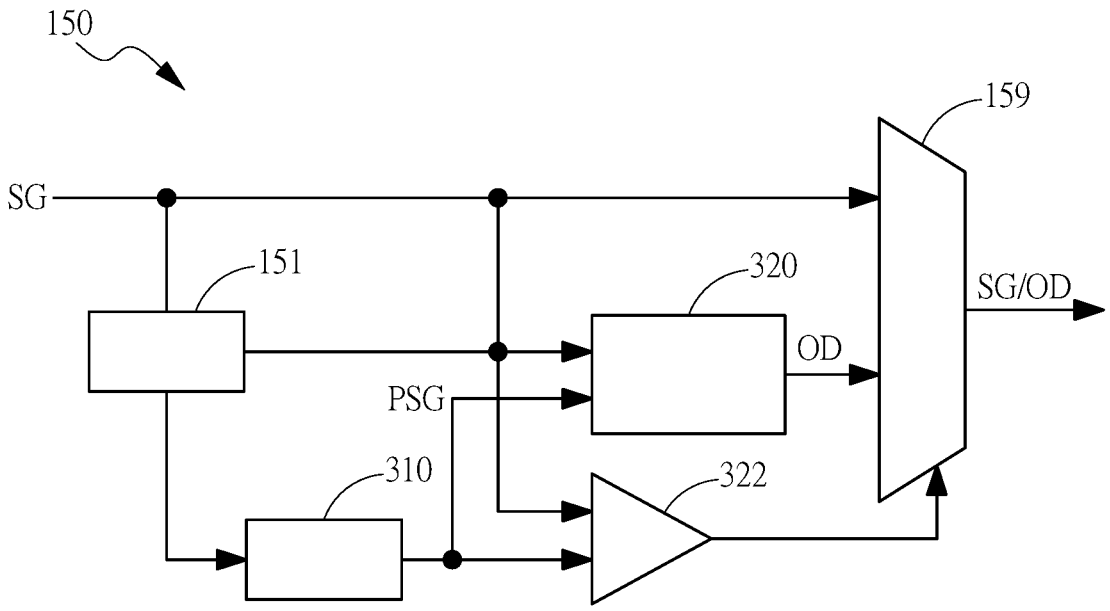
FIG. 2 is a systematic block diagram of an exemplary source driver in FIG. 1.

FIG. 2 is a systematic block diagram of an exemplary source driver in FIG. 1. Referring to FIG. 2, the source driver 150 includes a data processing unit 151, a frame buffer (example: Pixel information processing unit) 310, an over-driving calculating unit 320 (example: Over-driving correspondence selection unit), a comparator 322, (example: Querying and comparing unit) and a multiplexor 159. The data processing unit 151 is configured to convert the current grayscale value SG to a value in a data format satisfying the frame buffer 310, to store a converted current grayscale value SG in the frame buffer 310. The data processing unit 151 may convert the data format of the current grayscale value SG by means of table lookup, or convert the data format of the current grayscale value SG by means of mathematical operation. In addition, if a data format of the frame buffer 310 is the same as the data format of the current grayscale value SG the data processing unit 151 may be omitted. The frame buffer 310 is configured to store the current grayscale value SG, and output the current grayscale value SG as a previous grayscale value PSG during a next output period of a same pixel. The over-driving calculating unit 320 performs over-driving calculation according to the current grayscale value SG and the previous grayscale value PSG, to output a target over-driving value OD corresponding to the current grayscale value SG and the previous grayscale value PSG The comparator 322 compares the current grayscale value SG with the previous grayscale value PSG, to control the multiplexor 159 to output the target over-driving value OD when the current grayscale value SG is different from the previous grayscale value PSG, and to control the multiplexor 159 to output the current grayscale value SG when the current grayscale value SG is the same as the previous grayscale value PSG Referring to FIG. 1 and FIG. 2, when the over-driving calculating unit 320 performs an over-driving operation, the over-driving calculating unit 320 first obtains a first grayscale reference value and a second grayscale reference value being close to the current grayscale value SG according to a look-up table (LUT), and obtains a first previous grayscale reference value and a second previous grayscale reference value being close to the previous grayscale value PSG In addition, then the over-driving calculating unit 320 obtains four first over-driving values with reference to the first grayscale reference value, the second grayscale reference value, the first previous grayscale reference value, and the second previous grayscale reference value. Next, the over-driving calculating unit 320 performs four-point interpolation operation or parallelogram interpolation operation according to the current grayscale value SG, the previous grayscale value PSG, the first grayscale reference value, the second grayscale reference value, the first previous grayscale reference value, the second previous grayscale reference value, and the foregoing first over-driving values, to obtain the target over-driving value OD corresponding to the current grayscale value SG and the previous grayscale value PSG The grayscale reference values and the previous grayscale reference values are grayscale values and previous grayscale values recorded in the LUT. In addition, the current grayscale value SG and the previous grayscale value PSG used in the operation jointly correspond to a same pixel (for example, a pixel P) in the LCD panel 118.

Figure 3A:
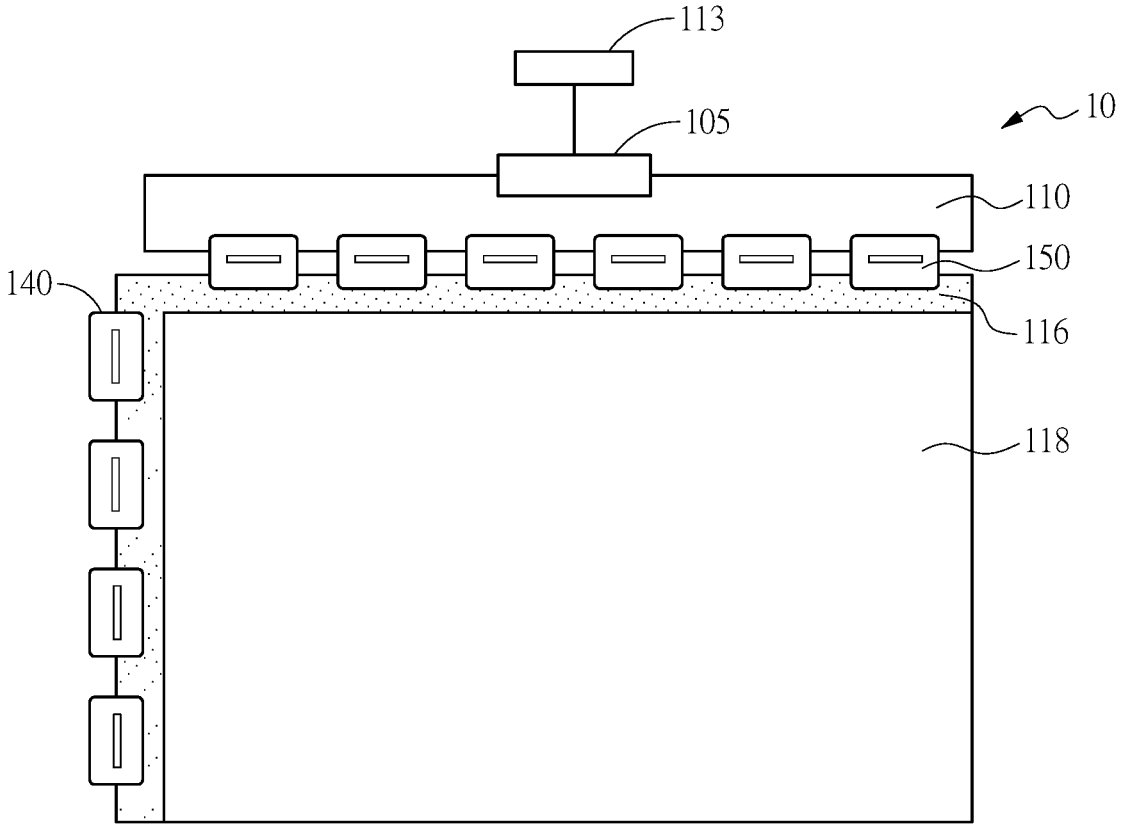
FIG. 3*a* is a schematic diagram of a display device according to an embodiment of this application.
Figure 3B:
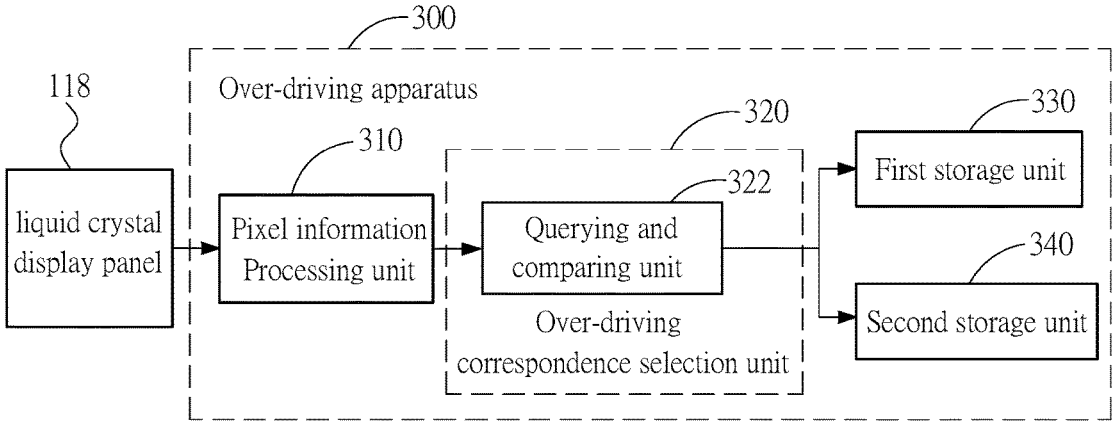
FIG. 3*b* is a structural block diagram of an over-driving apparatus according to an embodiment of this application.

FIG. 3*a* is a schematic diagram of a display device according to an embodiment of this application. FIG. 3*b* is a structural block diagram of an over-driving apparatus according to an embodiment of this application. FIG. 4*a* is an OD table storing a second-color pixel and a third-color pixel according to an embodiment of this application. FIG. 4*b* is an OD table storing a first-color pixel according to an embodiment of this application. Referring to FIG. 3*a*, FIG. 3*b*, FIG. 4*a*, and FIG. 4*b*, an over-driving apparatus 300 is applied to an LCD panel 118, and is configured to receive a plurality of pixel grayscale values corresponding to one pixel in a plurality of images and output a plurality of over-driving grayscale values correspondingly, and the over-driving apparatus 300 includes: a pixel information processing unit 310, configured to recognize a color information of the pixel; a first storage unit 330, configured to store the pixel grayscale values; a second storage unit 340, configured to store a difference value of the pixel grayscale values stored in the first storage unit 330; and an over-driving correspondence selection unit 320, separately electrically coupled to the pixel information processing unit 310, the first storage unit 330, and the second storage unit 340, and configured to select, according to the color information, recognized by the pixel information processing unit 310, of the pixel, whether the pixel grayscale values of the pixel need to correspond to the first storage unit 330 or the second storage unit 340.

In an embodiment, the over-driving correspondence selection unit 320 further includes: a querying and comparing unit 322, configured to determine, through query and comparison, whether the pixel should obtain data from the first storage unit 330 to perform over-driving or obtain data from the second storage unit 340 to perform over-driving.

In an embodiment, the pixel grayscale values stored in the first storage unit 330 are fixed values.

In an embodiment, the difference value stored in the second storage unit 340 and is of the pixel grayscale values stored in the first storage unit 330 is a variable value.

In an embodiment, the over-driving apparatus further includes a plurality of data driving chips (example: the source driver) 150, a plurality of gate driving chips (example: the gate driver) 140, and a power control chip 113.

In an embodiment, the over-driving apparatus further includes a timing controller 105, separately electrically connected to the data driving chips 150, the gate driving chips 140, and the power control chip 113.

Referring to FIG. 3*a*, in an embodiment, a display device 10 further includes a printed circuit board 110 and an output flat cable area 116.

Referring to FIG. 4*a* and FIG. 4*b*, in an embodiment, FIG. 4*a* is an OD table corresponding to red and green, and FIG. 4*b* is an OD table corresponding to blue. Assuming that during actual optical adjustment, it is discovered that, only 4 pieces of data in OD data corresponding to blue are different from OD data corresponding to red and green, a1 to a16 are data needed by over-driving in the table of FIG. 4*a*, b1, b4, b7, and b15 are difference values between the table of FIG. 4*a* and the table of FIG. 4*b*, and there is no data at the other positions in the table of FIG. 4*b*. During actual application, a system determines whether the table of FIG. 4*a* or the table of FIG. 4*b* is suitable for each pixel. If the pixel is a red or green pixel, the table of FIG. 4*a* is looked up, and an over-driving operation is performed according to found data. If the pixel is a blue pixel, the table of FIG. 4*b* is looked up. If required data is one of b1, b4, b7, and b15, an over-driving operation is performed according to found data. If the data found in the table of FIG. 4*b* is null, an over-driving operation is performed according to data at a corresponding position in the table of FIG. 4*a*. Therefore, only difference values between the table of FIG. 4*a* and the table of FIG. 4*b* need to be recorded in the table of FIG. 4*b*.

Figure 5:
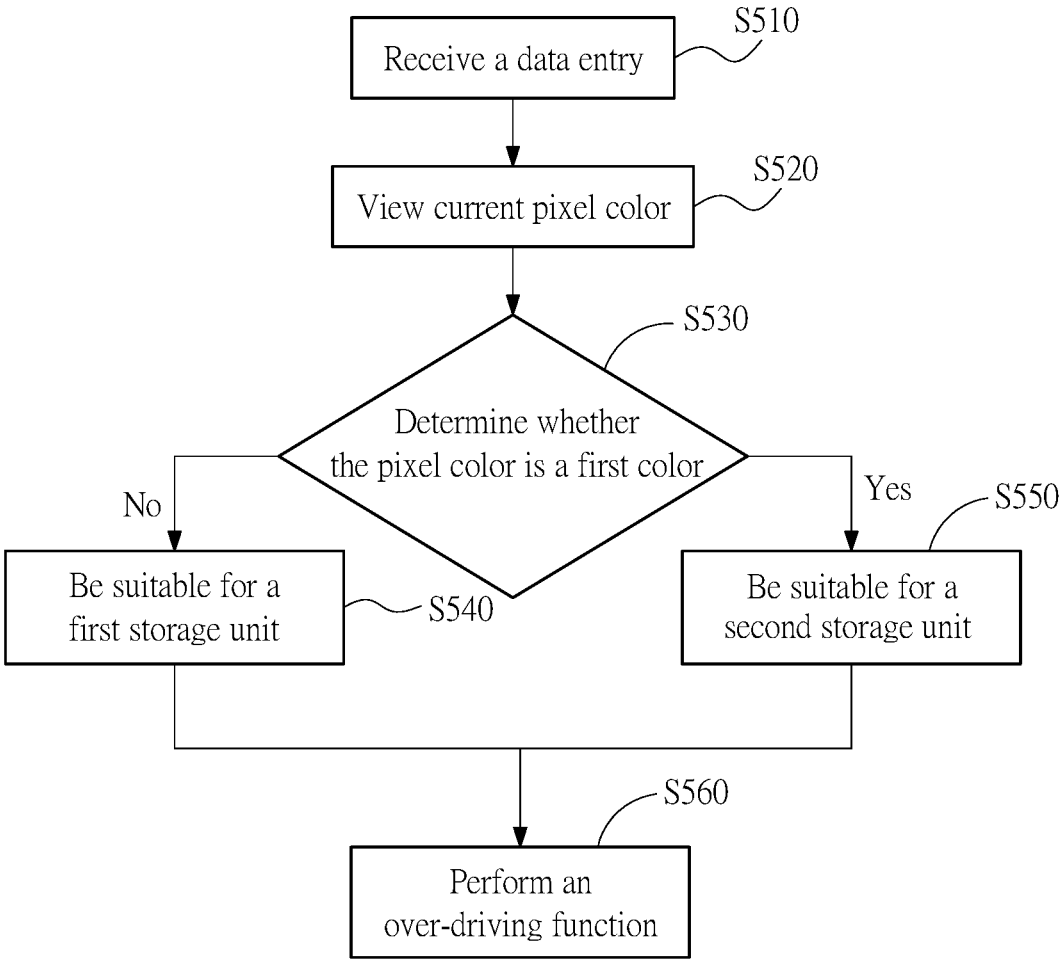
FIG. 5 is a flowchart of a method for storing over-driving values according to an embodiment of this application.

FIG. 5 is a flowchart of a method for storing over-driving values according to an embodiment of this application. Referring to FIG. 3*a*, FIG. 3*b*, and FIG. 5, a storage method of an over-driving apparatus 300 includes: receiving, by a pixel information processing unit 310, a pixel generated by an LCD panel 118; recognizing, by the pixel information processing unit 310, the pixel, to obtain pixel grayscale values; selecting, by an over-driving correspondence selection unit 320, a corresponding result of the pixel grayscale values; and determining, according to the corresponding result of the pixel grayscale values, whether the pixel is stored in a first storage unit 330 or a second storage unit 340. The over-driving apparatus 300 includes a plurality of data driving chips 150, a plurality of gate driving chips 140, and a power control chip 113.

In an embodiment, in the storage method, the step of determining, according to the corresponding result of the pixel grayscale values, whether the pixel is stored in a first storage unit 330 or a second storage unit 340 includes: determining, by a querying and comparing unit 322, the corresponding result of the pixel grayscale values, where the querying and comparing unit 322 is configured to query and compare where the pixel should obtain data from the first storage unit 330 to perform over-driving or obtain data from the second storage unit 340 to perform over-driving.

In an embodiment, in the storage method, a timing controller 105 is further included, and the timing controller 105 is separately electrically connected to the data driving chips 150, the gate driving chips 140, and the power control chip 113.

Referring to FIG. 5, in a block 510, a data input is received.

Referring to FIG. 5, in a block 520, a current pixel color is viewed.

Referring to FIG. 5, in a block 530, whether the pixel color is a first color is determined.

Referring to FIG. 5, in a block 540, the pixel color is not the first color, and is suitable for a first storage unit.

Referring to FIG. 5, in a block 550, the pixel color is the first color, and is suitable for a second storage unit.

Referring to FIG. 5, in a block 560, an over-driving function is performed.

Figure 6:
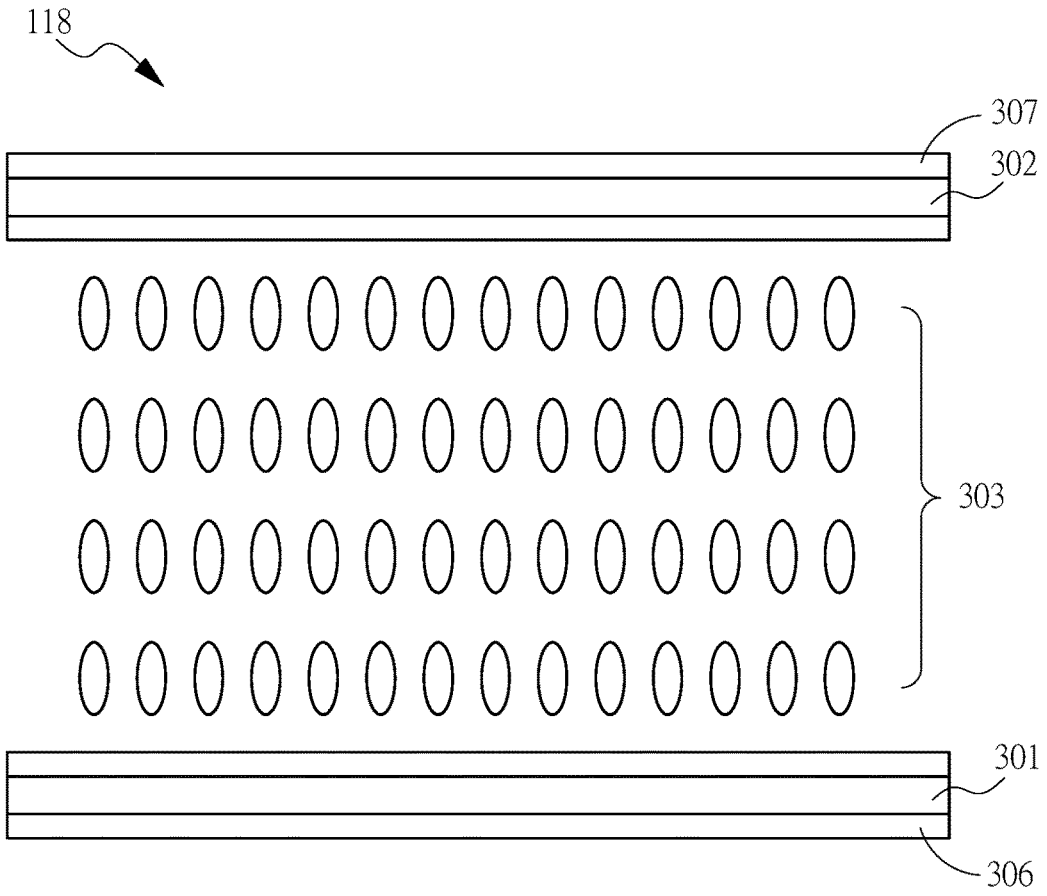
FIG. 6 is a schematic diagram of an LCD panel according to an embodiment of this application.

FIG. 6 is a schematic diagram of an LCD panel according to an embodiment of this application. Referring to FIG. 3*a*, FIG. 3*b*, and FIG. 6, in an embodiment of this application, an LCD panel 118 includes: a first substrate 301 (for example, a TFT substrate); a second substrate 302 (for example, a CF substrate), disposed opposite to the first substrate 301; and a liquid crystal layer 303, disposed between the first substrate 301 and the second substrate 302. The LCD panel 118 further includes an over-driving apparatus 300, disposed between the first substrate 301 and the second substrate 302 (for example, disposed on a surface of the first substrate 301). In addition, the LCD panel 118 further includes a first polarizer 306 disposed on an external surface of the first substrate 301 and a second polarizer 307 disposed on an external surface of the second substrate 302. A polarization direction of the first polarizer 306 is parallel to a polarization direction of the second polarizer 307.

This application reduces storage costs by reducing space needed by over-driving storage, so as to improve the quality of products.

Terms such as "in some embodiments" and "in various embodiments" are repeatedly used. Usually, the terms do not refer to the same embodiment; but they may also refer to the same embodiment. Words such as "include", "have", "include" are synonyms, unless other meanings are indicated in the context.

The foregoing descriptions are merely preferred embodiments of this application, and are not intended to limit this application in any form. Although this application has been disclosed above through the preferred embodiments, the embodiments are not intended to limit this application. Any person skilled in the art can make some equivalent variations or modifications according to the foregoing disclosed technical content without departing from the scope of the technical solutions of this application to obtain equivalent embodiments. Any simple amendment, equivalent change or modification made to the foregoing embodiments according to the technical essence of this application without departing from the content of the technical solutions of this application shall fall within the scope of the technical solutions of this application.

What is claimed is:

1. An over-driving apparatus, applied to a liquid crystal display (LCD) panel, and configured to receive a plurality of pixel grayscale values corresponding to one pixel in a plurality of images and output a plurality of over-driving grayscale values correspondingly, wherein the over-driving apparatus comprises:

a pixel information processing unit, configured to receive a color information of the pixel, the pixel information processing unit electrically coupled to the liquid crystal display;

a first storage unit, configured to store the pixel grayscale values;

a second storage unit, configured to store a difference value of the pixel grayscale values stored in the first storage unit; and an over-driving correspondence selection unit, separately electrically coupled to the pixel information processing unit, the first storage unit, and the second storage unit, and configured to select, according to the color information, received by the pixel information processing unit, of the pixel, whether the pixel grayscale values of the pixel need to correspond to the first storage unit or the second storage unit;

wherein the over-driving correspondence selection unit further comprises: a querying and comparing unit, which is a comparator device, configured to determine, through query and comparison, whether the pixel should obtain data from the first storage unit to perform over-driving or obtain data from the second storage unit to perform over-driving;

wherein the pixel grayscale values stored in the first storage unit are fixed values;

wherein the difference value stored in the second storage unit and of the pixel grayscale values stored in the first storage unit is a variable value.

2. The over-driving apparatus according to claim 1, further comprising a plurality of data driving chips, a plurality of gate driving chips, and a power control chip.

3. The over-driving apparatus according to claim 2, further comprising a timing controller, separately electrically connected to the data driving chips, the gate driving chips, and the power control chip.

4. A display device, comprising:

a first substrate;

a second substrate, disposed opposite to the first substrate;

a first polarizer, disposed on an external surface of the first substrate; a second polarizer, disposed on an external surface of the second substrate, wherein a polarization direction of the first polarizer is parallel to a polarization direction of the second polarizer; and an over-driving apparatus, comprising:

a pixel information processing unit, configured to receive a color information of the pixel, the pixel information processing unit electrically coupled to the liquid crystal display;

a first storage unit, configured to store pixel grayscale values;

a second storage unit, configured to store a difference value of the pixel grayscale values stored in the first storage unit; and an over-driving correspondence selection unit, separately electrically coupled to the pixel information processing unit, the first storage unit, and the second storage unit, and configured to select, according to the color information, received by the pixel information processing unit, of the pixel, whether the pixel grayscale values of the pixel need to correspond to the first storage unit or the second storage unit, wherein the over-driving apparatus is disposed on the first substrate or on the second substrate;

wherein the over-driving correspondence selection unit further comprises: a querying and comparing unit, configured to determine, through query and comparison, whether the pixel should obtain data from the first storage unit to perform over-driving or obtain data from the second storage unit to perform over-driving;

wherein the pixel grayscale values stored in the first storage unit are fixed values;

wherein the difference value stored in the second storage unit and of the pixel grayscale values stored in the first storage unit is a variable value.

5. The display device according to claim 4, further comprising a plurality of data driving chips, a plurality of gate driving chips, and a power control chip.

6. The display device according to claim 5, further comprising a timing controller, separately electrically connected to the data driving chips, the gate driving chips, and the power control chip.

* * * * *